US011554396B2

(12) United States Patent
Bergmann et al.

(10) Patent No.: US 11,554,396 B2
(45) Date of Patent: Jan. 17, 2023

(54) CLEANING ROLLING STOCK DURING COLD ROLLING OF THE ROLLING STOCK

(71) Applicant: Primetals Technologies Austria GmbH, Linz (AT)

(72) Inventors: Martin Bergmann, Linz (AT); Konrad Krimpelstaetter, Gallneukirchen (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 222 days.

(21) Appl. No.: 16/619,284

(22) PCT Filed: Jun. 12, 2018

(86) PCT No.: PCT/EP2018/065449
§ 371 (c)(1),
(2) Date: Dec. 4, 2019

(87) PCT Pub. No.: WO2019/001945
PCT Pub. Date: Jan. 3, 2019

(65) Prior Publication Data

US 2020/0139416 A1 May 7, 2020

(30) Foreign Application Priority Data

Jun. 29, 2017 (EP) ..... 17178803

(51) Int. Cl.
*B21B 45/00* (2006.01)
*B21B 45/02* (2006.01)
*B21B 1/22* (2006.01)

(52) U.S. Cl.
CPC .... *B21B 45/0275* (2013.01); *B21B 2001/221* (2013.01)

(58) Field of Classification Search
CPC . B21B 45/02; B21B 45/0275; B21B 45/0287; B21B 45/06; B21B 45/08; B08B 3/022; B08B 3/024
See application file for complete search history.

(56) References Cited

U.S. PATENT DOCUMENTS 3,192,752 A 7/1965 Dowd et al.
2015/0217336 A1* 8/2015 Seidel ..... B08B 3/041 134/122 R

FOREIGN PATENT DOCUMENTS

DE 30 28 285 2/1981
DE 282 632 A5 9/1990
JP S56-169781 A 12/1981
JP H02-15817 A 1/1990
(Continued)

OTHER PUBLICATIONS

Machine Translation of EP 02015817 (Year: 1990).*
(Continued)

*Primary Examiner* — Debra M Sullivan
(74) *Attorney, Agent, or Firm* — Ostrolenk Faber LLP

(57) ABSTRACT

A method for cleaning rolling stock (5) during cold rolling of the rolling stock (5) in a tandem mill (1) which includes a plurality of mill stands (7, 9). The rolling stock (5) is moved through the tandem mill (1) in a direction of movement (3) and a cleaning liquid (26) is sprayed onto the rolling stock (5) between two roll stands (7, 9) in a spraying direction having a component opposite to that of the direction of movement (3).

12 Claims, 4 Drawing Sheets

(56) References Cited

FOREIGN PATENT DOCUMENTS

| | | |
|---|---|---|
| JP | H10-258301 A | 9/1998 |
| WO | WO 95/05251 A1 | 2/1995 |

OTHER PUBLICATIONS

Japanese Office Action, dated Mar. 8, 2021, issued in corresponding Japanese Patent Application No. 2019-572081. English translation. Total 10 pages.
International Search Report dated Aug. 17, 2018 in corresponding PCT International Application No. PCT/EP2018/065449.
Written Opinion dated Aug. 17, 2018 in corresponding PCT International Application No. PCT/EP2018/065449.
Extended European Search Report dated Dec. 14, 2017 in corresponding European Patent Application No. 17178803.7.

* cited by examiner

CLEANING ROLLING STOCK DURING COLD ROLLING OF THE ROLLING STOCK

CROSS-REFERENCE TO RELATED APPLICATIONS

The present application is a 35 U.S.C. §§ 371 national phase conversion of PCT/EP2018/065449, filed Jun. 12, 2018, the contents of which are incorporated herein by reference, which claims priority of European Patent Application No. 17178803,7 filed Jun. 29, 2017, the contents of which are incorporated by reference herein. The PCT International Application was published in the German language.

TECHNICAL BACKGROUND

The invention relates to a method for cleaning a workpiece during cold rolling of the workpiece.

During cold rolling of a workpiece, the workpiece, which is generally a metal strip, normally undergoes multiple deformations, wherein each deformation reduces the thickness of the workpiece. The deformations are carried out, for example, in a so-called tandem mill wherein the workpiece is moved in one direction of rolling through a plurality of mill stands arranged in tandem along the direction of rolling and each mill stand produces a deformation. Alternatively or in addition, in so-called reversing rolling, the workpiece is moved alternately in opposite directions of rolling through the same mill stand in a plurality of rolling passes, wherein deformation of the workpiece is produced in each pass.

A mill stand generally has two work rolls disposed one above the other which are separated by a roll gap through which the workpiece is passed. To reduce friction between the workpiece and the work rolls, a rolling emulsion is applied to the workpiece and/or to the work rolls. A rolling emulsion generally contains water, rolling oil and an emulsifier in order to make the rolling oil miscible with the water. An emulsion may additionally contain other components, e.g. at least one antioxidant, a wear protection additive and/or a corrosion protection additive.

During cold rolling, metal particles are abraded from the workpiece and from the work rolls. In addition, emulsion residues, particularly rolling oil, continue to adhere to the workpiece. The abraded metal particles and emulsion residues contaminate the surface of the cold-rolled workpiece and adversely affect its surface quality. To reduce such impurities, it is attempted, for example, to minimize the contamination of the surface of the workpiece in the cold rolling plant e.g. by keeping the equipment clean, appropriate maintenance or having a low oil concentration in the emulsion. The workpiece is also cleaned, for example, after cold rolling. The cleaning is effected by mechanical means (e.g. by brushing), in combination with a fluid or chemically.

DD 282 632 A5 discloses a device for cleaning cold-rolled strip as it exits the roll gap. The device is in the form of a retaining plate on which V-shaped mechanical scrapers are mounted and which additionally incorporates holes for the application of cleaning agent to the workpiece. A mechanical scraping device is by its nature subject to wear. In addition, hard particles that may have entered the scraping device can scratch the surface of the workpiece.

DE 30 28 285 A1 discloses a method for cleaning metal strips during cold rolling, wherein a cleaning solution is sprayed onto the upper and lower surface of the metal strip immediately before and after the last rolling operation. However, if the workpiece is only cleaned before and after the last rolling operation, metal particles that have already been firmly rolled into the surface of the workpiece prior to the last rolling operation can either no longer be removed at all or can only be removed with great effort from the surface of the workpiece.

SUMMARY OF THE INVENTION

The object of the invention is to specify an improved method for cleaning a workpiece during cold rolling of the workpiece.

A first embodiment of the method according to the invention relates to cleaning a workpiece during cold rolling of the workpiece in a tandem mill comprising a plurality of mill stands. In this embodiment, the workpiece is moved through the tandem mill in one direction of rolling. Between two mill stands, a cleaning liquid is sprayed onto the moving workpiece in a spraying direction having a component that is counter to the direction of rolling.

This embodiment enables the workpiece to be cleaned between two mill stands of a tandem mill. This means that any contamination of the workpiece after its passage through a mill stand can be removed before the workpiece enters the subsequent stand. This prevents metal particles abraded during passage through a stand from being rolled into the surface of the workpiece by the subsequent stand, as they will have already been removed from the workpiece before it enters the subsequent stand.

The advantage of cleaning the workpiece by spraying it with a cleaning liquid, as compared to mechanical scraping of metal particles and emulsion residues from the workpiece, is that contact of the cleaning device with the workpiece and therefore mechanical wear of the cleaning device due to contact thereof with the workpiece is avoided. The metal particles to be removed have sizes on the order to a few μm and are removed solely by the mechanical effect of the cleaning spray jet. An elevated temperature of the cleaning liquid is therefore unnecessary, thereby advantageously obviating the need for a heater and associated energy requirement, unlike conventional strip cleaning systems located downstream of the tandem mill. The spraying of the workpiece in a spray direction having a component that is counter to the direction of rolling advantageously increases the cleaning effect of the spraying by means of a spray direction component that is counter to the movement of the metal particles and emulsion residues.

Variants of the first embodiment of the invention provide that cleaning liquid is sprayed onto the workpiece between the first and second mill stand and/or between the second and third mill stand of the tandem mill. The first mill stand of a tandem mill is to be understood as meaning the tandem mill stand through which the workpiece initially passes. Accordingly, the second and third mill stand of a tandem mill are to be understood as meaning, respectively, the second and third tandem mill stand through which the workpiece passes.

The above variant of the first embodiment of the method takes into account that, in a tandem mill, most of the metallic abrasion arises in the first two stands of the tandem mill, as the workpiece entering the tandem mill has a high degree of surface roughness and is still relatively soft and thick, compared to its state when it passes through the downstream mill stand. The surface roughness of the workpiece decreases with each rolling operation, whereas the surface hardness of the workpiece increases with each rolling operation. As a result, the metallic abrasion of the workpiece also decreases with each rolling operation. It is therefore advantageous to clean the workpiece as early as after the first and/or second stand of the tandem mill in order to prevent the large amount of metal particles abraded during passage of the workpiece through the first two mill stands from being rolled into the surface of the workpiece by the following stands and the abraded particles no longer being able to be removed or able to be removed only with great time and effort. This enables the cleanliness and surface quality of the workpiece to be significantly improved, as compared to not cleaning the workpiece until the end of the tandem mill, and allows subsequent cleaning measures to be reduced.

A second embodiment of the method according to the invention relates to cleaning the workpiece during reversing of cold rolling of the workpiece in a mill stand. Here the workpiece is moved through the mill stand alternately in opposite directions of rolling in a plurality of passes. Between two passes, a cleaning liquid is sprayed onto the workpiece in a direction having a component counter to the direction of rolling.

The second embodiment of the method according to the invention corresponds to the first embodiment except that the cleaning of the workpiece between two mill stands as it passes through a tandem mill is replaced by cleaning between two reversing rolling passes.

Accordingly, variants of the second embodiment of the method, which are analogous to the above mentioned variants of the first embodiment, provide that cleaning liquid is sprayed onto the workpiece between the first rolling pass and the second rolling pass and/or between the second rolling pass and the third rolling pass.

A variant of the invention provides that an emulsion is used as a cleaning liquid. In particular, that emulsion may be the same as that which is also used to reduce friction between the workpiece and the rolls of the tandem mill stands or the rolls of the reversing rolling stand. As a result, at least some of the pipework of an existing emulsion system of the cold rolling plant can also be used for cleaning the workpiece, thereby reducing pipework cost/complexity.

Alternatively water, for example, can be used as a cleaning liquid. Using water reduces workpiece cleaning costs as compared to using special cleaning liquids.

Another variant of the invention provides that the cleaning liquid is sprayed onto the workpiece at a pressure of between 6 and 100 bar. Relatively large quantities of emulsion are used during cold rolling, e.g. approximately 6000 l/min for each mill stand. This typically produces, on the upper side of the workpiece, an emulsion "lake" a few millimeters deep through which the cleaning liquid has to force its way in order to dislodge the metal particles and emulsion residues from the workpiece. To achieve this, the cleaning liquid is typically sprayed onto the workpiece at a pressure of between 6 and 100 bar.

In another variant of the invention, the spraying direction has a component which is directed toward an edge region of the workpiece. This causes the metal particles and emulsion residues of the cleaning liquid sprayed onto the workpiece to be moved toward an edge region of the workpiece where they can be removed from the workpiece.

In another variant of the invention, depending on a spraying position sprayed with cleaning liquid, the spraying direction is varied across the width of the workpiece at right angles to the direction of rolling. This means that the metal particles and emulsion residues of the cleaning liquid sprayed onto the workpiece can be moved in particular to an edge region nearest to the spraying position.

In a further development of the two above mentioned variants of the invention, the component of the spraying direction which is directed toward an edge region of the workpiece is directed, depending on the spraying position, toward the workpiece edge region nearest to the spraying position.

In another variant of the invention, a spraying angle between the spraying direction and a workpiece surface can be adjusted. This enables the spraying direction of the respective cold rolling plant to be adapted in order to optimize the cleaning effect in a plant-dependent manner.

In another variant of the invention, the cleaning liquid is sprayed onto the upper side and onto the lower side of the workpiece. This variant takes into account that generally both sides of a workpiece are contaminated by metal particles and emulsion residues during cold rolling, and cleaning of both sides is therefore advantageous.

A tandem mill for cold rolling a workpiece that is moved in one direction of rolling through the tandem mill comprises a succession of mill stands disposed along the direction of rolling and, between two of the mill stands, at least one spraying bar having a plurality of nozzles through which cleaning liquid can be sprayed onto the workpiece in a spraying direction having a component counter to the direction of rolling. The arrangement of a spraying bar having a plurality of nozzles for spraying the workpiece with cleaning liquid between two mill stands makes the inventive method possible, with the above mentioned advantages for cleaning the workpiece during cold rolling of the workpiece in a tandem mill comprising a plurality of mill stands.

The above described characteristics, features and advantages of the invention and the way in which they are achieved will become clearer and more readily comprehensible in conjunction with the following description of exemplary embodiments which will be explained in greater detail with reference to the accompanying drawings in which:

DESCRIPTION OF EMBODIMENTS

Figure 1:
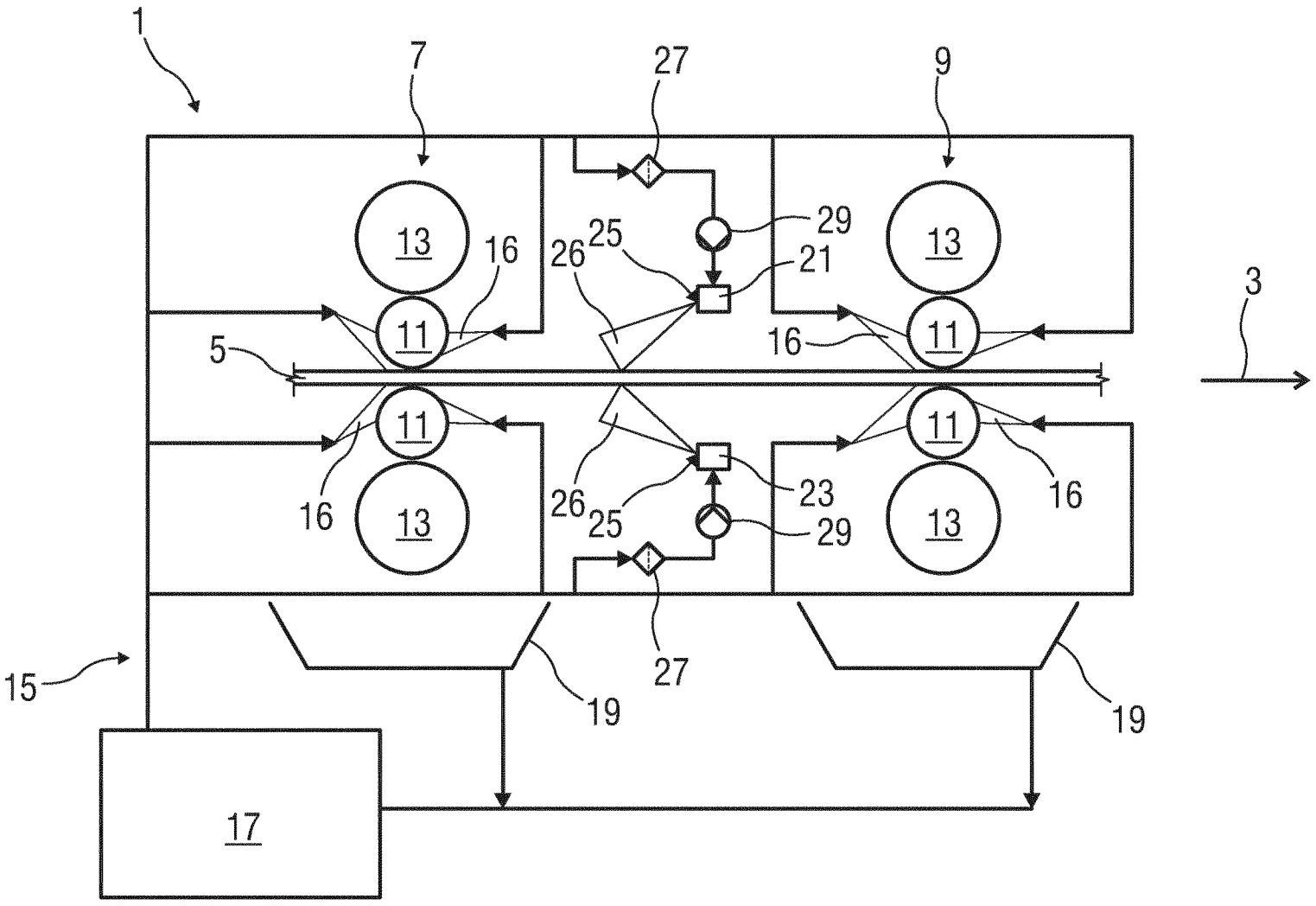
FIG. 1 shows a section of a first exemplary embodiment of a tandem mill.

Corresponding parts are provided with the same reference characters in the figures.

FIG. 1 schematically illustrates a section of a first exemplary embodiment of a tandem mill 1 for cold rolling a workpiece 5, in this case a metal strip, that is moved in one direction of rolling 3 through the tandem mill 1.

The tandem mill 1 comprises a plurality mill stands 7, 9, of which only two are shown in FIG. 1. In particular, the two mill stands 7, 9 shown can be a first and a second mill stand 7, 9 or a second and a third mill stand 7, 9 of the tandem mill 1. Each mill stand 7, 9 has two work rolls 11 disposed one above the other and separated by a roll gap through which the workpiece 5 is passed and thereby rolled. Each mill stand 7 also has a backup roll 13 for each work roll 11.

The tandem mill 1 additionally comprises an emulsion system 15 for dispensing an emulsion 16 onto the work roll 11 and the workpiece 5. The emulsion 16 generally contains water, rolling oil and an emulsifier in order to make the rolling oil miscible with the water. The emulsion 16 may also have other constituents, e.g. at least one antioxidant, a wear protection additive and/or a corrosion protection additive. The emulsion 16 is dispensed, on the entry side of the moving strip 5, into the region of the roll gap of each mill stand 7, 9, onto the upper side and lower side of the workpiece 5 and the two work rolls 11 of the mill stand 7, 9 and, on the exit side of the strip, is dispensed onto the two work rolls 11 of the mill stand 7, 9. The term entry side denotes the side of a mill stand 7, 9 from which the workpiece 5 is fed into the mill stand 7, 9, and the term exit side denotes the side of the mill stand 7, 9 opposite the entry side.

The emulsion system 15 has an emulsion tank 17 for storing emulsion 16 to be dispensed and, for each mill stand 7, 9, has a collecting vessel 19 for collecting emulsion 16 that drips off the mill stand 7, 9. The emulsion system 15 also has pipework wherein emulsion 16 is conveyed from the collecting vessels 19 into the emulsion tank 17 and from the emulsion tank 17 to the mill stands 7.

Two spraying bars 21, 23 for cleaning the workpiece 5 are disposed between the first mill stand 7 and the second mill stand 9, including an upper spraying bar 21 disposed above the workpiece 5 and lower spraying bar 23 disposed below the workpiece 5.

Each spraying bar 21, 23 has a plurality of spray nozzles 25 from which a cleaning liquid 26 can be sprayed onto the workpiece 5 in a spraying direction having a spray component that is counter to the direction of rolling 3. In this exemplary embodiment, the sprayed cleaning liquid 26 is a filtered emulsion 16 which is supplied to the spraying bars 21, 23 from the emulsion system 15 via a filter 27 and a pump 29 in each case. The filters 27 are used to separate contaminants, particularly metal particles abraded from the workpiece 5 and the work rolls 11, from the emulsion 16. The pumps 29 each produce a pressure of between 6 and 100 bar at which the cleaning liquid 26 is sprayed onto the workpiece 5. The vertical distance of the nozzles 25 from the workpiece 5 is e.g. approximately 20 cm. Examples of spraying bars 21, 23 will be described in more detail below with reference to FIGS. 3 to 6.

Similarly to the spraying bars 21, 23 shown in FIG. 1, spraying bars 21, 23 can also be disposed between other mill stands 7, 9 of the tandem mill 1.

Figure 2:
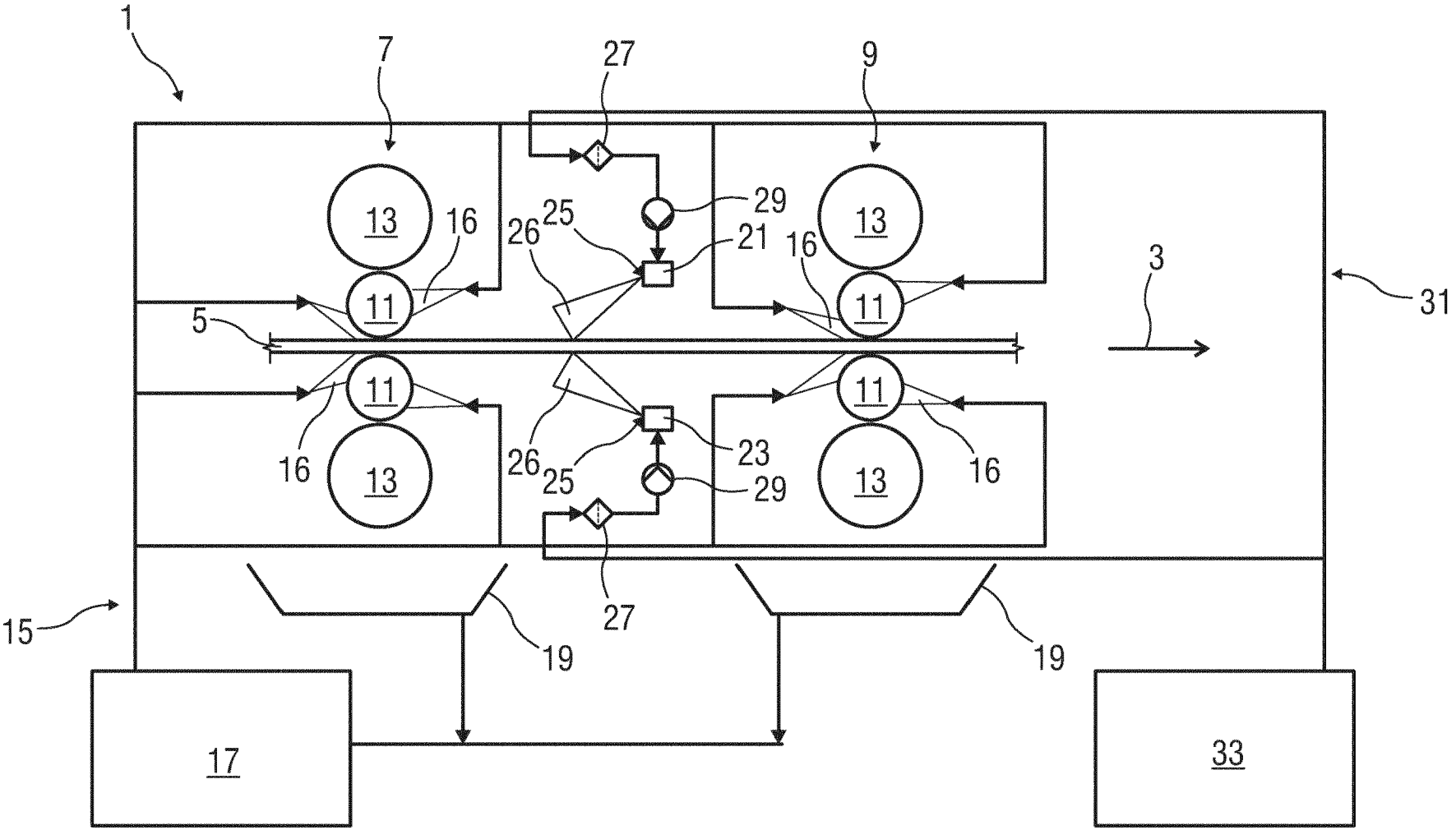
FIG. 2 shows a section of a second exemplary embodiment of a tandem mill.

FIG. 2 schematically illustrates a section of a second exemplary embodiment of a tandem mill 1 for cold rolling a workpiece 5, in this case metal strip, moved in one direction of rolling 3 through the tandem mill 1. This exemplary embodiment differs from the exemplary embodiment shown in FIG. 1 only in that the spraying bars 21, 23 are not fed from the emulsion system 15 but are fed from a separate cleaning system 31 which supplies the spraying bars 21, 23 with a cleaning liquid 26 that is different from the emulsion 16 of the emulsion system 15.

The cleaning liquid 26 in this exemplary embodiment is, for example, an emulsion similar to the emulsion 16 of the emulsion system 15, but the composition is different from that of the emulsion 16 of the emulsion system 15 to improve the cleaning effect. Alternatively, the cleaning liquid 26 is water, for example.

The cleaning system 31 comprises a cleaning liquid tank 33 for storing cleaning liquid 26 to be supplied to the respective spraying bars 21, 23 via a pump 29 and optionally via a filter 27.

Figure 3:
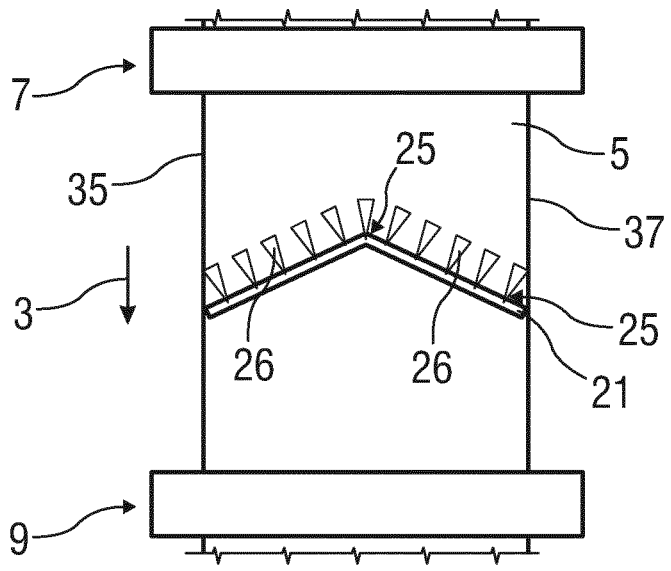
FIG. 3 shows a plan view of a first exemplary embodiment of a spraying bar between two mill stands.
Figure 4:
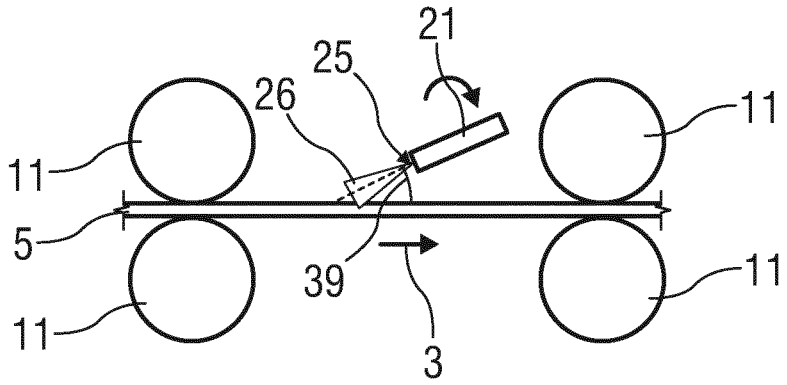
FIG. 4 shows a side view of the spraying bar illustrated in FIG. 3 between two mill stands.

FIGS. 3 and 4 schematically illustrate a first exemplary embodiment of a spraying bar 21 that is between two mill stands 7, 9. FIG. 3 shows a plan view of the spraying bar 21, the workpiece 5 and the mill stands 7, 9, and FIG. 4 shows a side view of the spraying bar 21, the workpiece 5 and the work rolls 11 of the mill stands 7, 9, with only one spray jet being shown in FIG. 4 for the sake of clarity.

The spraying bar 21 extends above the workpiece 5 between opposite edge regions 35, 37 of the workpiece 5. The spraying bar 21 has two spraying arms each extending from the center of the spraying bar 21 toward one of the edge regions 35, 37 and forming an angle with each other, so that the spraying bar 21 is V-shaped, wherein the apex of the V faces the mill stand 7 through which the workpiece 5 initially passes. The nozzles 25 of the spraying bar 21 are disposed on an outlet side of the spraying bar 21, in which outlet side faces the mill stand 7 through which the workpiece 5 initially passes. Each nozzle 25 is directed to spray cleaning liquid 26 onto the workpiece 5 in a spraying direction having a component counter to the direction of rolling.

Figure 5:
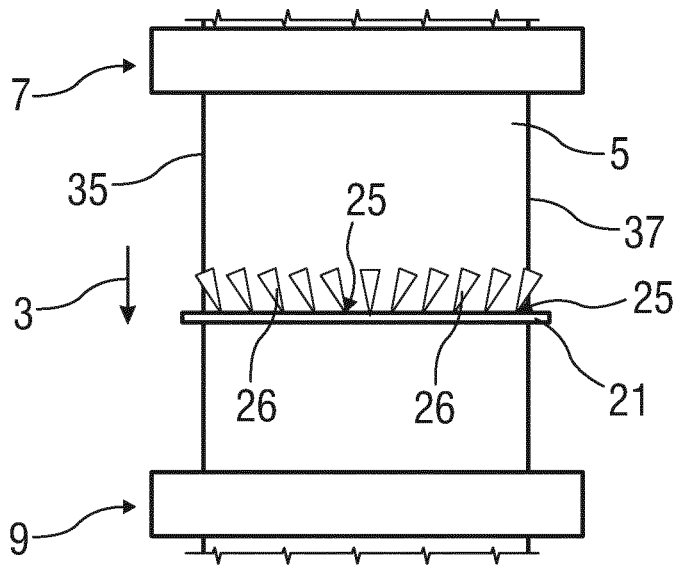
FIG. 5 shows a plan view of a second exemplary embodiment of a spraying bar between two mill stands.
Figure 6:
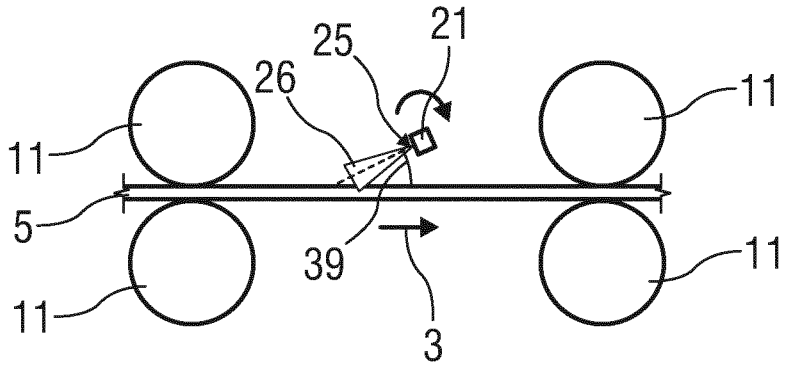
FIG. 6 shows a side view of the spraying bar shown in FIG. 5 between two mill stands.

FIGS. 5 and 6 schematically illustrate a second exemplary embodiment of a spraying bar 21 between two mill stands 7, 9. Similarly to FIG. 3, FIG. 5 shows a plan view of the spraying bar 21, the workpiece 5 and the mill stands 7, 9, and, similarly to FIG. 4, FIG. 6 shows a side view of the spraying bar 21, the workpiece 5 and the work rolls 11 of the mill stands 7, 9.

In contrast to the first exemplary embodiment shown in FIGS. 3 and 4, the spraying bar 21 in the second embodiment does not extend in a V-shaped manner but extends in a straight line above and across the workpiece 5 between opposite edge regions 35, 37 of the workpiece 5. The nozzles 25 of the spraying bar 21 are again disposed on an outlet side of the spraying bar 21, which outlet side faces the mill stand 7 through which the workpiece 5 initially passes. Each nozzle 25 applies cleaning liquid 26 to the workpiece 5 in a spraying direction having a component counter to the direction of rolling 3.

In the two exemplary embodiments of a spraying bar 21 shown in FIGS. 3 to 6, the spraying direction of each nozzle 25 has a component which is directed at the edge region 35, 37 closest to the respective nozzle 25. In the exemplary embodiment shown in FIGS. 3 and 4, this is achieved by the V-shape of the spraying bar 21, wherein the cleaning liquid 26 can be delivered perpendicular to the line of the respective leg of the spraying bar. In the exemplary embodiment shown in FIGS. 5 and 6 this is achieved by the orientation of the nozzles 25 of the spraying bar 21. The exemplary embodiment shown in FIGS. 3 and 4 therefore allows a simpler arrangement of the nozzles 25 in the spraying bar 21 compared to the exemplary embodiment shown in FIGS. 5 and 6, whereas the exemplary embodiment shown in FIGS. 5 and 6 has a simpler geometric form of the spraying bar 21 itself than the exemplary embodiment shown in FIGS. 3 and 4.

In both the exemplary embodiments of a spraying bar 21 shown in FIGS. 3 to 6, the spraying bar 21 may also be pivotally mounted so that the spraying angle 39 between the spraying direction and the surface of the workpiece 5 sprayed with the cleaning liquid 26 can be adjusted.

The nozzles 25 are e.g. flat fan nozzles, each having a spray profile that widens out from the nozzle 25 to the workpiece 5. Alternatively, the nozzles 25 can be implemented as full jet nozzles having a spray profile of essentially constant cross-section.

The inventive cleaning of the workpiece 5 is inexpensive to acquire and is easy to connect to existing plant automation, as no other facilities are necessary for connecting the spraying bars 21, 23 apart from one additional pump 29, possibly a filter 27 for removing contaminants and one control valve for each spraying bar 21, 23 or group of spraying bars. In addition, as the spraying bars 21, 23 spray the cleaning liquid 26 onto the workpiece 5 under relatively high pressure, only a much smaller amount of cleaning liquid 26, e.g. approximately 500 l/min per inter-stand region, is applied to the workpiece 5 compared to emulsion 16 from the emulsion system 15 (e.g. 6000 l/min per stand 7, 9), so that the cooling behavior of the workpiece 5 is not significantly affected by the additional spraying bars 21, 23 and therefore complex control of the quantities of cleaning liquid delivered by the spraying bars 21, 23 is unnecessary. The spraying bars 21, 23 are simply connected with a constant throughput in terms of flow rate and volume. For the above reasons, the inventive cleaning of the workpiece 5 is also suitable as an inexpensive retrofit solution for existing tandem mills 1.

Although the invention has been illustrated and described in detail by preferred exemplary embodiments, the invention is not limited by the examples disclosed and other variations will be apparent to persons skilled in the art without departing from the scope of protection sought for the invention.

LIST OF REFERENCE CHARACTERS

1 tandem mill
3 direction of rolling
5 workpiece
7, 9 mill stand
11 work roll
13 backup roll
15 emulsion system
16 emulsion
17 emulsion tank
19 collecting vessel
21, 23 spraying bars
25 nozzle
26 cleaning liquid
27 filter
29 pump
31 cleaning system
33 cleaning tank
35, 37 edge region
39 spraying angle

The invention claimed is:

1. A method for cleaning a workpiece during cold rolling of the workpiece in a tandem mill having a plurality of mill stands, the workpiece having a first edge and a second edge opposite the first edge, the method comprising:

moving the workpiece through the tandem mill in one direction of rolling; and spraying a cleaning liquid from a plurality of nozzles of a spraying bar between two of the mill stands onto the workpiece in a spraying direction having a component that is counter to the direction of rolling, no spraying direction of each of the plurality of nozzles being oriented to cross each other, and pivoting the spraying bar to adjust a spraying angle of the plurality of nozzles between the spraying direction and a surface of the workpiece, wherein each nozzle of the plurality of nozzles is either closer to the first edge of the workpiece and farther from the second edge of the workpiece, or closer to the second edge of the workpiece and farther from the first edge of the workpiece, wherein each nozzle of the plurality of nozzles is oriented to spray the cleaning liquid in a respective spray direction toward the edge of the workpiece that is closer thereto, and none of the nozzles from the plurality of nozzles is oriented to spray the cleaning liquid in a respective spray direction toward the edge of the workpiece that is farther thereto.

2. The method as claimed in claim 1, wherein the cleaning liquid is sprayed onto the workpiece between the first mill stand and the second mill stand of the plurality of mill stands.

3. The method as claimed in claim 1, further comprising spraying the cleaning liquid onto the workpiece between the second mill stand and the third mill stand of the plurality of mill stands.

4. The method as claimed in claim 1, further comprising using an emulsion as the cleaning liquid.

5. The method as claimed in claim 1, further comprising using water as the cleaning liquid.

6. The method as claimed in claim 1, further comprising spraying the cleaning liquid onto the workpiece at a pressure of between 6 and 100 bar.

7. The method as claimed in claim 1, further comprising varying the spraying direction of the cleaning liquid across a width of the workpiece at right angles to the direction of rolling.

8. The method as claimed in claim 1, further comprising spraying the cleaning liquid on an upper surface and a lower surface of the workpiece.

9. A method for cleaning a workpiece during opposite direction reversing cold rolling of the workpiece in a mill stand, the workpiece having a first edge and a second edge opposite the first edge, the method comprising:

moving the workpiece through the mill stand in alternately opposite directions of rolling the workpiece in a plurality of rolling passes; and between two of the rolling passes, spraying a cleaning liquid, from a plurality of nozzles, the plurality of nozzles being arranged along only a single continuous line starting at the first edge and ending at the second edge of the workpiece, onto the workpiece in a spraying direction having a component that is counter to the direction of rolling, no spraying direction of each of the plurality of nozzles being oriented to cross each other, wherein each first nozzle of the plurality of nozzles is closer to the first edge of the workpiece and farther from the second edge of the workpiece, wherein each second nozzle of the plurality of nozzles is closer to the second edge of the workpiece and farther from the first edge of the workpiece, wherein each nozzle of the plurality of nozzles is oriented to spray the cleaning liquid in a respective spray direction toward the edge of the workpiece that is closer thereto, and none of the nozzles from the plurality of nozzles that is arranged along the single continuous line is oriented to spray the cleaning liquid in a respective spray direction toward the edge of the workpiece that is farther thereto.

10. The method as claimed in claim 9, further comprising spraying the cleaning liquid onto the workpiece between a first rolling pass and a second rolling pass.

11. The method as claimed in claim 9, further comprising spraying the cleaning liquid onto the workpiece between a second rolling pass and a third rolling pass.

12. A tandem mill for cold rolling of a workpiece that is being moved in one direction of rolling through the tandem mill, the tandem mill comprising:

a plurality of mill stands arranged in tandem along the one direction of rolling; and at least one spraying bar disposed between two of the mill stands, the spraying bar being pivotable to permit adjustment of a spraying angle between a spraying direction and a surface of the workpiece, the spray bar having a plurality of nozzles from which a cleaning liquid is sprayed onto the workpiece in a spraying direction having a component that is counter to the direction of rolling, no spraying direction of each of the plurality of nozzles being oriented to cross each other, wherein each nozzle of the plurality of nozzles is either closer to a first edge of the workpiece and farther from a second edge of the workpiece, or closer to the second edge of the workpiece and farther from the first edge of the workpiece, wherein each nozzle of the plurality of nozzles is oriented to spray the cleaning liquid in a respective spray direction toward the edge of the workpiece that is closer thereto, and none of the nozzles from the plurality of nozzles is oriented to spray the cleaning liquid in a respective spray direction toward the edge of the workpiece that is farther thereto.

* * * * *